United States Patent [19]

Clark

[11] 4,312,181

[45] Jan. 26, 1982

[54] HEAT ENGINE WITH VARIABLE VOLUME DISPLACEMENT MEANS

[76] Inventor: Earl A. Clark, 1143 Manchester Ave., Norfolk, Va. 23508

[21] Appl. No.: 48,427

[22] Filed: Jun. 14, 1979

[51] Int. Cl.[3] ..... F02G 1/04

[52] U.S. Cl. ..... 60/519

[58] Field of Search ..... 60/517, 519, 651, 671; 62/6; 92/38, 120; 91/339

[56] References Cited

U.S. PATENT DOCUMENTS

| | | | |
|---|---|---|---|
| 355,634 | 1/1887 | Baldwin et al. | 60/519 |
| 3,460,344 | 8/1969 | Johnson | 60/519 |
| 3,987,767 | 10/1976 | Buske | 60/517 X |
| 4,099,448 | 7/1978 | Young | 92/120 X |

*Primary Examiner*—Allen M. Ostrager
*Assistant Examiner*—Stephen F. Husar
*Attorney, Agent, or Firm*—Griffin, Branigan & Butler

[57] ABSTRACT

A heat engine based on the Stirling cycle in which the conventional displacer piston and power piston are replaced by a single variable volume displacement unit. The variable volume displacement unit is disposed in a chamber having a heat input side and a heat removal side, and comprises two pivotally supported baffle plates movable relative to each other. The baffle plates divide the chamber into first, second and third regions each of variable volume, with the total volume of the three regions remaining constant. A regenerator interconnects the first and second regions for removing heat from, or returning heat to, a working fluid as it passes back and forth between the first and second regions. In the third region, a driving mechanism interconnects the baffle plates to time their movements and drive the output means which may be located outside of the chamber or inside the chamber within the third region. The mechanical linkage is arranged such that movement of one of the baffle plates causes the other baffle plate to move at a different rate thereby varying the volume of the third region during the isothermal expansion and isothermal compression phases of a cycle. Condensate from the working fluid may be collected and returned to the working fluid as the fluid passes into the regenerator from the cold side, the condensate return line including a pump and a throttle valve for controlling the speed of operation of the engine.

33 Claims, 18 Drawing Figures

HEAT ENGINE WITH VARIABLE VOLUME DISPLACEMENT MEANS

BACKGROUND OF THE INVENTION

The present invention relates to a Stirling cycle engine for deriving mechanical or electrical output power from heat. More particularly, the present invention relates to a heat engine having a single variable volume displacement unit which performs the work of a displacement piston in causing flow of the working fluid in either direction between the hot and cold sides of the engine during the isothermal compression and expansion phases of a cycle, and also performs the work of a drive piston in driving a power output means.

One widely used configuration of the Stirling cycle engine employs two reciprocating pistons, one called a displacer piston for moving the working fluid back and forth through a regenerator, and the other called a working or power piston. These engines suffer from several disadvantages. It is difficult to synchronize the movements of the pistons and various expensive ways including the "rhombic drive" have been devised for accomplishing the synchronization mechanically. Also, the piston configuration requires the input of energy in mechanical form to drive the displacer piston. This creates sealing problems in addition to the sealing problems attendant to removing the useful output in the form of a reciprocating mechanical movement. Finally, the configuration of the prior art engines does not easily permit heat transfers over large surface areas, an obvious disadvantage when the engine is to be powered by heat derived from solar energy or other "waste" heat sources.

BRIEF SUMMARY OF THE INVENTION

An object of the present invention is to provide, in a heat engine having means defining a chamber, displacement means disposed within the chamber and separating the chamber into first and second regions, and a regenerator path connecting the first and second regions and forming a bypass around the displacement means for a working fluid, the improvement wherein the displacement means comprises a variable volume displacement means for displacing a variable volume within the chamber between the first and second regions whereby the pressure in the first and second regions may be varied.

A further object of the invention is to provide a heat engine as described above wherein the variable volume displacement means comprises first and second baffle plates defining a third region disposed intermediate the first and second regions. The baffle plates may be hinged or pivotally supported about a common axis or, in an alternative embodiment, about separate parallel axes. The baffle plates may be flat solid plates, plates of variable thickness, solid, or hollow, the latter case permitting the baffle plates to be used as additional heat transfer surfaces. The variable volume displacement means further includes drive means disposed within the third region and responsive to movement of one of the baffle plates for moving the other baffle plate. The drive means may comprise a wholly mechanical mechanism or it may comprise a fluid actuated mechanism. Output power is derived from the drive means and may comprise an electrical generator disposed within the third region, or outside of the heat engine and driven by a shaft extending into the third region.

A further object of the invention is to provide, in a Stirling cycle device having means defining a working chamber of constant volume, the improvement comprising first and second means disposed within the chamber and defining with the chamber first, second and third regions each of variable volume. Means are included for moving the second means relative to the first means to thereby increase or decrease the volume of the third region while simultaneously decreasing or increasing, respectively the total volume in the first and second regions. The device further includes means for moving the first and second means at substantially the same rate in a first or second direction to thereby increase the volume in the second region while decreasing the volume in the first region, or increase the volume in the first region while decreasing the volume in the second region, the volume of the third region remaining substantially constant. A working fluid is disposed in the first and second regions and a flow path is provided for flow of the working fluid between the first and second regions. Means are provided for applying heat to the first region and removing heat from the second region and a regenerator means is disposed in the flow path for removing heat from or giving up heat to the working fluid as it flows between the first and second regions.

Other objects of the invention and its mode of operation will become apparent upon consideration of the following description and the accompanying drawings, the drawings not necessarily being to scale but instead being drawn to best illustrate the principles of the invention.

DETAILED DESCRIPTION OF THE DRAWINGS

Figure 1:
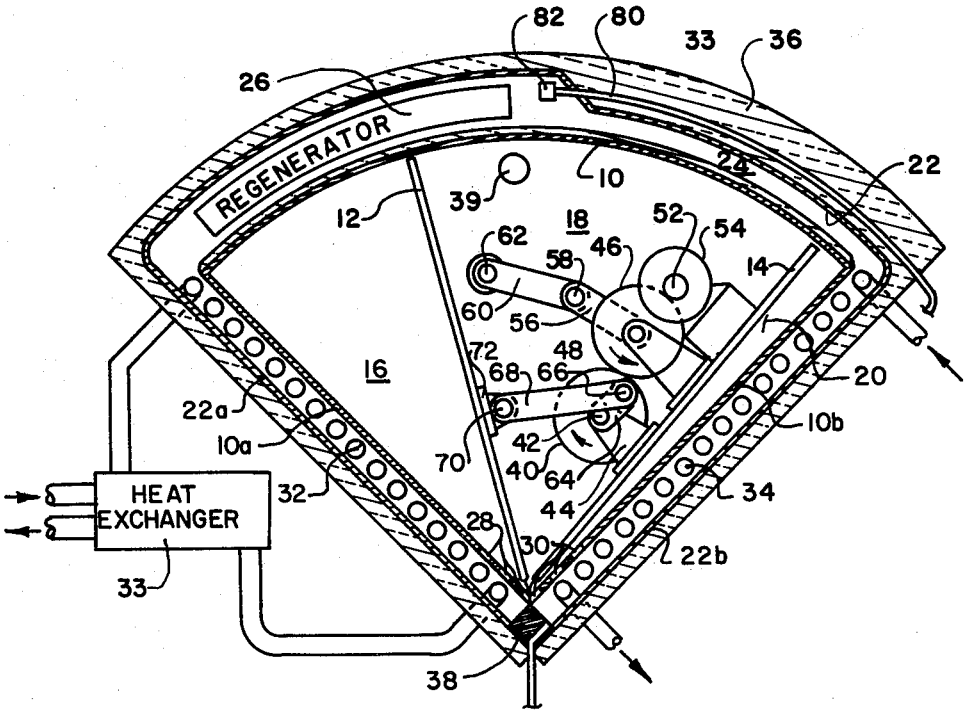
FIG. 1 illustrates a Stirling cycle engine having a variable volume displacement means disposed between the hot and cold sides of the engine.
Figure 7:
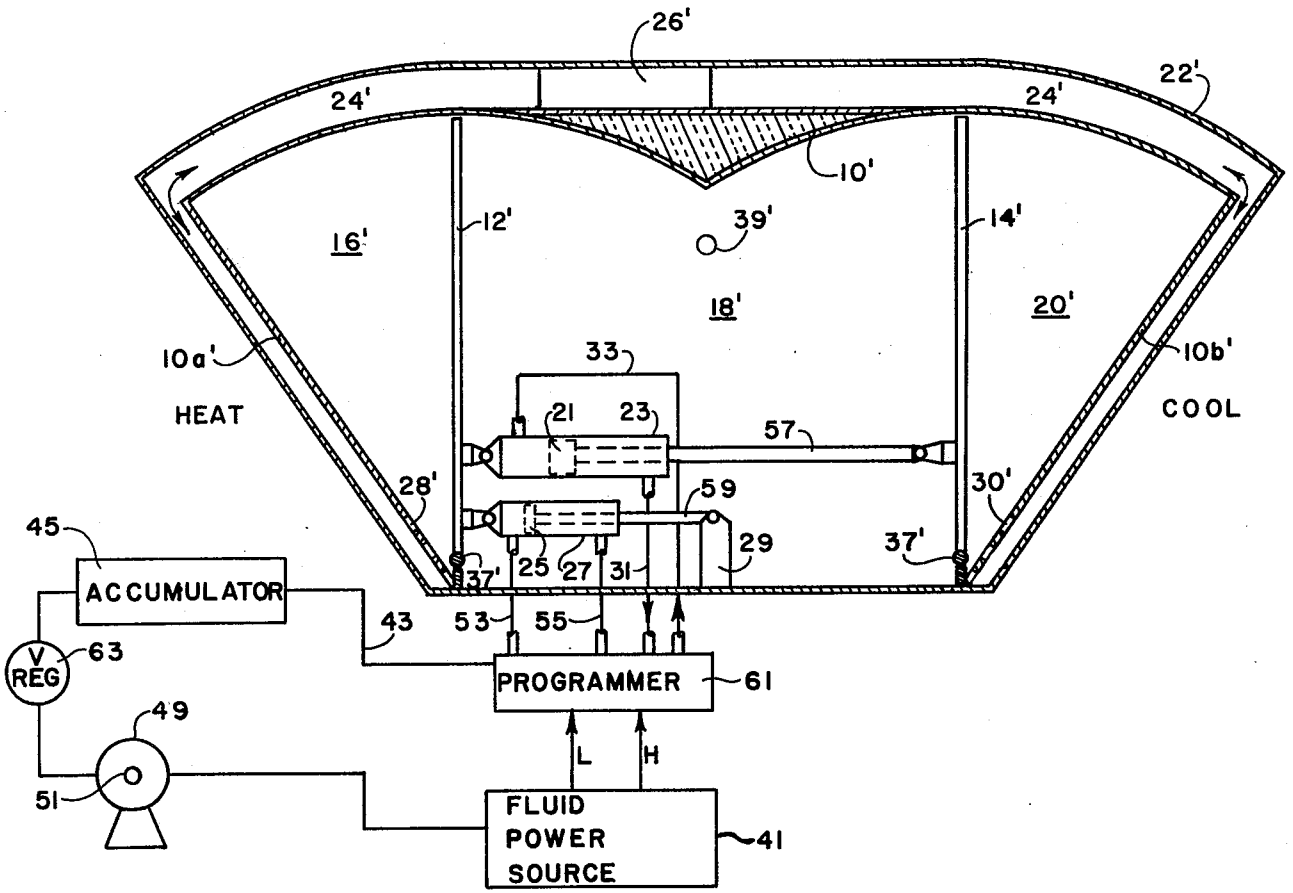
Figure 8B:
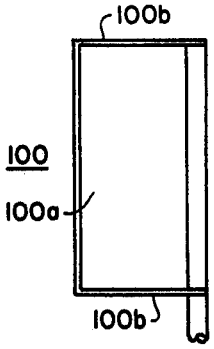
Figure 9B:
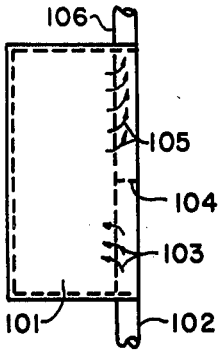
Figure 10:
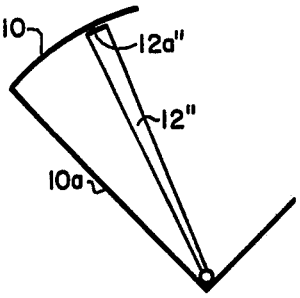
Figure 8A:
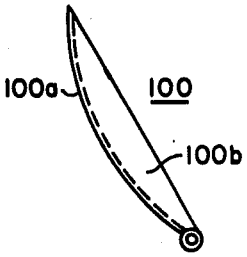
Figure 9A:
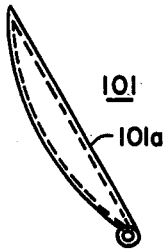
Figure 11:
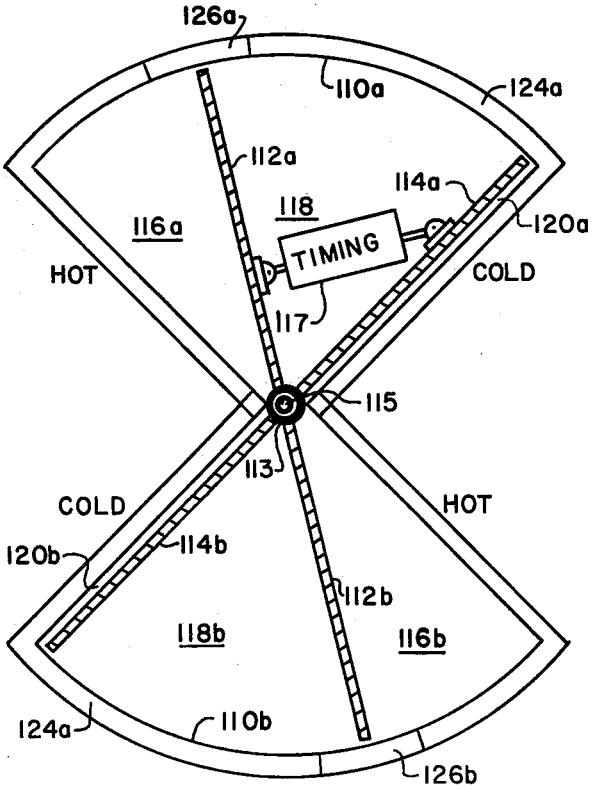

FIGS. 6*a*–6*f* are schematic diagrams illustrating the operation of the variable volume displacement mechanism of FIG. 1;

FIG. 7 illustrates a further embodiment of the invention employing fluid control mechanisms in the variable volume displacement unit;

FIGS. 8*a* and 8*b* illustrate an alternative construction for the baffle plates;

FIGS. 9*a* and 9*b* illustrate an embodiment of the baffle plates adapted to receive fluid and thus serve as a heat transfer surface;

FIG. 10 illustrates a modified baffle plate having a configuration providing for better sealing; and, FIG. 11 illustrates how a single baffle plate may be simultaneously employed in two separate engine chambers.

DETAILED DESCRIPTION OF THE INVENTION

Figure 2:
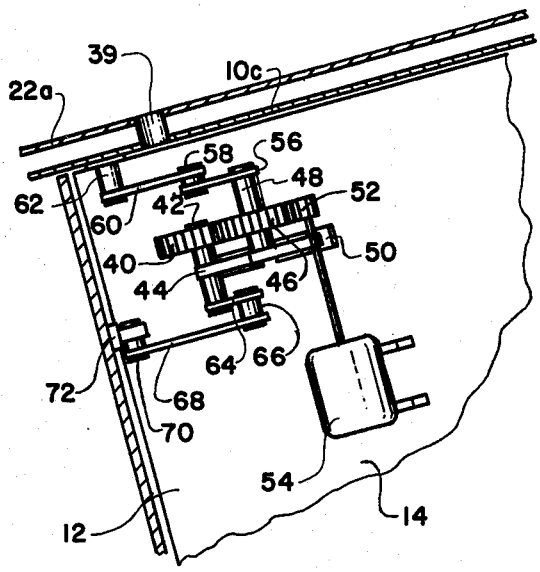
FIG. 2 is a part sectional top view of FIG. 1 illustrating the mechanical linkages of the variable volume displacement unit.

As illustrated in FIGS. 1 and 2, a heat engine constructed in accordance with the principles of the present invention comprises a metal housing 10 or other means defining a chamber, and first and second baffle plates 12 and 14 dividing the chamber into first, second and third regions 16, 18 and 20. A second housing 22 surrounds the housing 10 and defines therewith a regenerator return path 24 in which is disposed a regenerator means generally indicated at 26. Hot and cold walls 10*a* and 10*b* are provided with a plurality of perforations 28 and 30 so that the working fluid may be easily shifted back and forth between the first and second regions 16 and 20 by traveling a path between housings 10 and 22 and through the regenerator 26.

The working fluid fills the regions 16 and 20 as well as the regenerator 26 and return path 24. The particular working fluid utilized may vary depending upon the particular use and environment of the engine. The working fluid may be air or some refrigerant such as R-113 "Freon" if the working pressures of the fluid are low. On the other hand, other working fluids are preferred when, for example, the entire engine is enclosed in a pressurized vessel (not shown) so that it may work at higher pressures.

The side of the engine adjacent region 16 is the hot side. Piping 32 is provided between the housings 10 and 22 adjacent the region 16. A heating fluid such as water is heated in a heat exchanger 33 and circulated through piping 32 to heat a working fluid in, or about to enter, region 16. The side of the engine adjacent region 20 is the cold side. Piping 34 is provided between housings 10 and 22 adjacent the region 20 and a coolant is circulated through piping 34 to cool working fluid in, or about to enter, the region 20. The coolant may be water fed directly from a cool water source, or it may be some other coolant which has been cooled in a heat exchanger (not shown).

Thermal insulation 36 is shown in FIG. 1 as completely surrounding the outside of housing 22 with additional insulation 33 being disposed to insulate housing 10 from the fluid in regenerator return path 24. However, as subsequently explained, it may be desirable in some instances to have the insulation cover less than the entire outer surface of housing 22.

The embodiment illustrated in FIGS. 1 and 2 is, generally speaking, shaped like a sector of a cylinder. Thus, the housing 22 may be quite long with the end portions enclosed by end plates such as the plate 22*a* shown in FIG. 2. The regenerator means 26, as well as the pipes 32 and 34, extends the length of the sector perpendicular to the plane of the section shown in FIG. 1. Additional insulation 38 is provided at the apex of the sector extending along the length thereof to separate the hot and cold sides of the engine.

The thicknesses of the housings 10 and 22 may vary depending upon the pressure utilized in operating the engine, and in some cases may be sheet metal. The thicknesses of the plates 12 and 14 may also vary but these plates must be thick enough to support mechanical linkages as subsequently described.

The baffle plates 12 and 14 are supported in any suitable manner for pivotal or arcuate movement about one edge.

Figure 3:
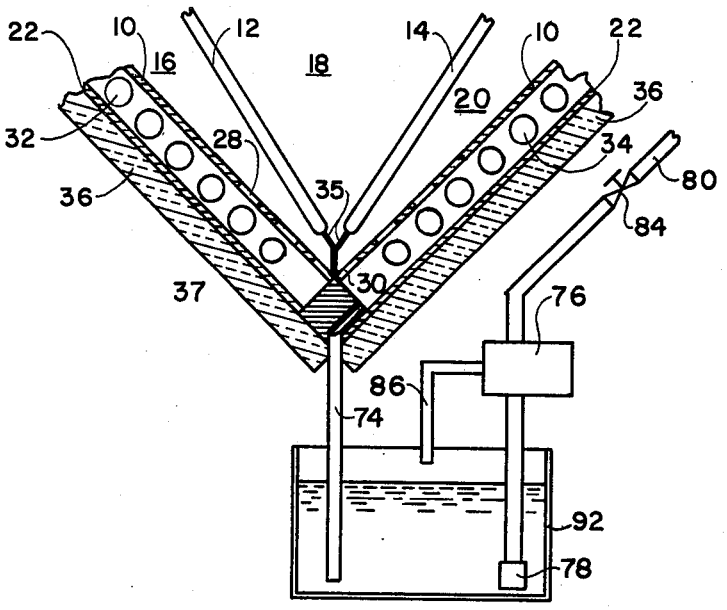
FIG. 3 illustrates a condensate return system suitable for use with the embodiment shown in FIG. 1.
Figure 4:
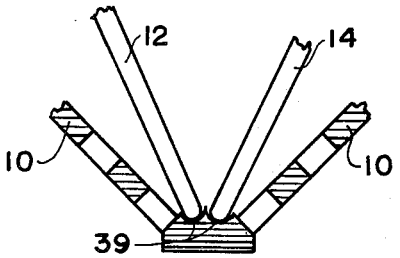
FIG. 4 illustrates one means of pivotally supporting the baffle plates of a variable volume displacement unit.

As best shown in FIG. 3, the baffle plates 12 and 14 may be hinged by hinges 35 to pivot about a common pivot axis 37. The hinges are desirable if the chamber 10 is not positioned with the apex of the chamber at the lowest point as shown in the drawings. However, if the chamber 10 is to be positioned as shown, the hinges 35 may be dispensed with and the baffle plates 12 and 14 pivotally supported in two parallel channels or grooves as schematically illustrated in FIG. 4. In this case, the bottom edges of baffles 12 and 14 as well as the groove surfaces may be curved to reduce friction and improve sealing.

FIG. 1 does not show seals between the upper ends of baffle plates 12 and 14 and the curved portion of housing 10. Suitable leather or plastic wiper seals or spring loaded roller bearing seals may be mounted on the baffle plates 12 and 14 as required. However, in many applications the working surfaces of baffle plates 12 and 14 will be so large that seals may not be required, the pressure losses because of the lack of seals being insignificant.

A vent opening 39 is disposed in an end wall of the housing 10, the location of the opening being such that it always communicates with the region 18. The opening 39 may be vented to the atmosphere or engine environment through a filter if the working fluid is air, or may be connected to a bellows (not shown) if another working fluid is utilized. As subsequently explained, the volume of region 18 varies as the engine passes through each cycle. The opening 39 permits the pressure in region 18 to remain substantially constant. A bellows, if used, merely prevents escape of the working fluid to the atmosphere or, if the engine is in a pressure vessel, to the engine environment within the vessel.

As illustrated in FIG. 1, the variable displacement means includes a timing or linkage means disposed between the baffle plates 12 and 14 in the region 18 and interconnecting the plates so that movement of one of the plates causes movement of the other plate. As subsequently explained with reference to FIGS. 6*a*–6*d*, the movements of the plates relative to each other vary. The linkage means includes a first gear 40 fixed to a shaft 42 mounted for free rotation in a support 44, and a second gear 46 fixed to a shaft 48 which is mounted for free rotation in a support 50. The supports 44 and 50 are attached to the baffle plate 14. The teeth of gears 40 and 46 mesh with each other and the teeth of gear 46 mesh with a drive gear 52 mounted on the shaft of a generator 54 which provides the useful output energy in the form of electrical power. Gears 40 and 46 have a 1:1 ratio.

A linkage arm 56 is attached at one end to the shaft 48 to move therewith. At the other end, linkage 56 is attached by a pivot 58 to a further linkage arm 60. At its other end, linkage arm 60 is attached to freely pivot on a pivot post 62 which is attached to the end wall 10*c* of the housing 10.

A linkage arm 64 is firmly attached at one end to the shaft 42 for rotation therewith. At its opposite end, linkage arm 64 is attached by a pivot 66 to one end of a linkage arm 68. The opposite end of linkage arm 68 is mounted to freely pivot on a pivot 70 which is supported by a support 72 attached to the baffle plate 12.

Figure 5:
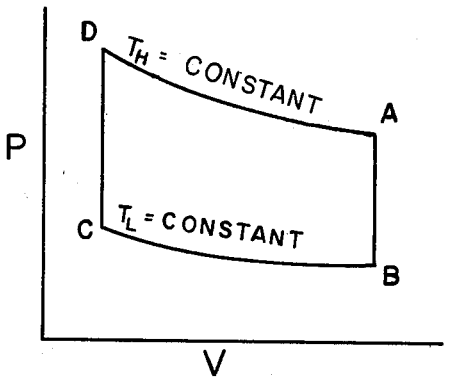
FIG. 5 is a pressure-volume diagram illustrating the ideal air-standard Stirling cycle.

The embodiment illustrated in FIG. 1 may best be understood by a consideration of FIGS. 5 and 6*a*–6*f*. FIG. 5 illustrates the ideal air-standard Stirling cycle. During the interval B-C a working fluid is compressed isothermally at a temperature $T_L$ to its minimum volume V. During the interval C-D heat is added to the fluid at a constant volume to bring it to a temperature $T_H$. During the interval D-A the fluid is expanded isothermally at $T_H$. Finally, during the interval A-B the working fluid is cooled at constant volume to bring it back to the temperature $T_L$.

Referring now to FIGS. 6a–6f, FIG. 6a schematically illustrates the position of the variable volume displacement means at or just before point A of the cycle illustrated in FIG. 5. Baffle plate 14 is closely adjacent the cold side of the engine so that the second region 20 is at its minimum volume. Linkages 56 and 60 are fully extended and the linkages 64 and 68 are approaching a position providing minimum separation between the baffle plates 12 and 14. At this point the baffle plate 12 still has a slight distance to travel in the clockwise direction in response to the pressure in region 16 which is greater at this point than the pressure in region 18. In moving this slight distance the linkages 64 and 68 rotate gear 40 which in turn rotates gear 46 and linkage 56. This in turn begins pulling the baffle plate 14 counterclockwise thus permitting working fluid from the cold side of the regenerator 26 to enter region 20. When linkages 64 and 68 become exactly aligned with minimum separation between plates 12 and 14, the momentum of gears 40 and 46 carries the linkages 64 and 68 past their dead center position thus drawing baffle plate 14 counterclockwise.

As baffle plate 14 begins moving counterclockwise the working fluid from region 16 is shifted into region 20 through regenerator 26, giving up heat to the regenerator. The pressure in regions 16 and 20 thus drops and as it does so the pressure in region 18 acts against baffle plates 12 and 14 tending to separate them. This causes extension of the linkages 64-68 thus rotating ggear 40. Gear 40 rotates linkage 56 thus drawing baffle plate 14 further counterclockwise.

Figure 6A:
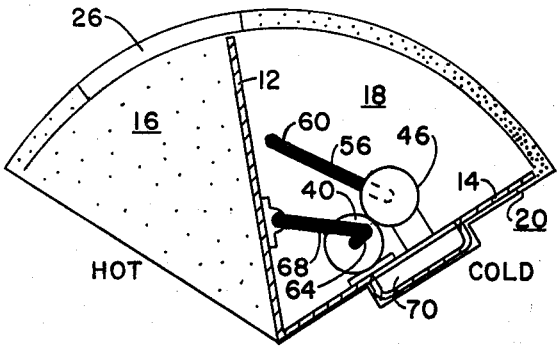
Figure 6B:
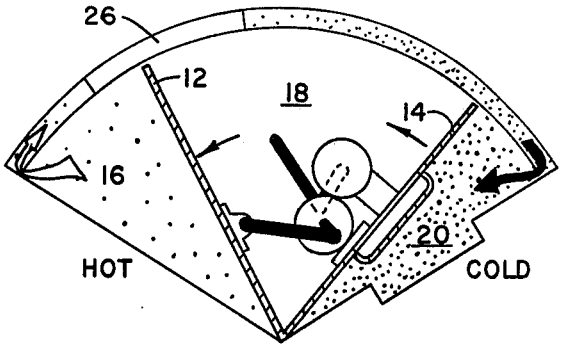
Figure 6C:
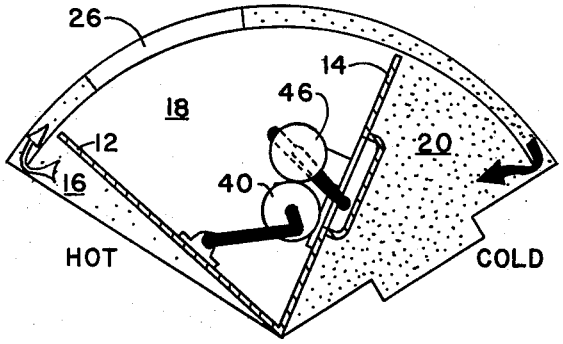

FIG. 6b shows the positions of the baffle plates 12 and 14 at a point in the cycle occuring shortly after point A in FIG. 5. The baffle plates 12 and 14 have approximately the same angular separation as shown in FIG. 6a and both plates have moved counterclockwise. During this counterclockwise movement some of the hot working fluid from region 16 has passed through the regenerator into the region 20, losing heat to the regenerator during passage therethrough. Ideally, the angular separation of plates 12 and 14 would remain constant during the interval A-B as shown in FIG. 5. However, in actual practice it is impossible to obtain the ideal condition with linkages 64, 68, 56 and 60. Thus, as shown in FIG. 6c the linkages interconnecting baffle plates 12 and 14 have begun to separate the plates at a point in the cycle slightly before plate 12 reaches its counterclockwise limit of travel. The hot working fluid is still being forced from region 16 through the regenerator to the cold region 20 hence the temperature of the working fluid is still dropping to $T_L$.

Figure 6D:
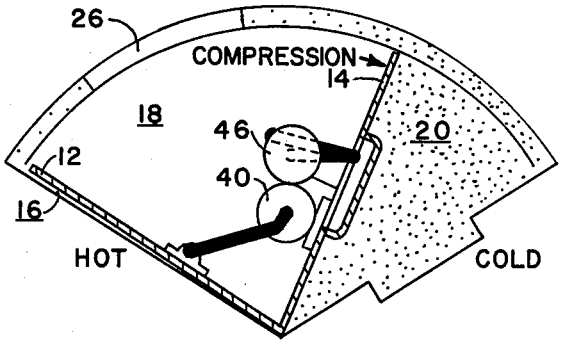

Shortly after occurrence of the conditions illustrated in FIG. 6c, the baffle plate 12 reaches its limit of travel in the counterclockwise direction while, at the same time, the baffle plate 14 begins a relatively rapid clockwise movement so that the angle between the baffle plates increases. This of course decreases the total volume contained within first and second regions 16 and 20 while increasing the volume within the third region 18. Thus, in moving from the position shown in FIG. 6c to the position shown in 6d the engine has passed through that portion of the cycle corresponding roughly to the phase B-C in FIG. 5. Actually, FIG. 6d illustrates the position of the baffle plates 12 and 14 slightly before point C in the cycle. The linkage mechanism interconnecting baffle plates 12 and 14 is still increasing the angle between the plates so that compression of the working fluid is still occuring.

Figure 6E:
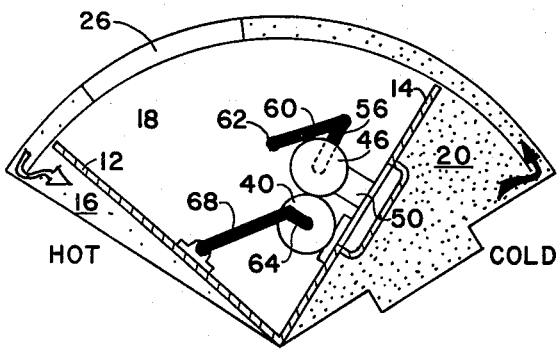
Figure 6F:
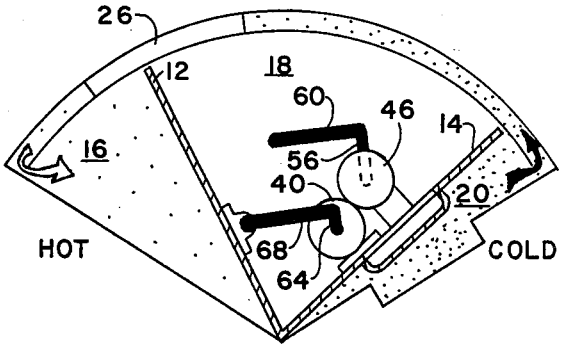

FIG. 6e illustrates the positions of baffle plates 12 and 14 shortly after point C in the cycle. The angle of separation between baffle plates 12 and 14 is at approximately its maximum value and baffle plate 12 has moved slightly clockwise from its counterclockwise limit of travel thus permitting some fluid from region 20 to pass through the regenerator, picking up heat therein, and into the region 16. In addition, heat applied to the wall of region 16 begins heating the working fluid to raise it to the temperature $T_H$. The expanding working fluid raises the pressure in regions 16 and 20 and acts against plates 12 and 14. The pressure in region 18 is now less than that in regions 16 and 20 so there is a force tending to move the plates toward each other. Linkages 68 and 64 collapse to rotate gear 40. This in turn rotates gear 46 thus rotating linkage 56 and applying a force to linkage 60. Since linkage 60 is fixed at the pivot 62 there is a force exerted through linkage 56, the pivot 48, and the support 50 to move the baffle plate 14 clockwise. Thus, both baffle plates 12 and 14 move clockwise as the working fluid expands. Ideally, the angular separation between baffle plates 12 and 14 should remain constant during this interval so that the volume within the region 18 remains constant as the engine moves from the position shown in FIG. 6e through the position shown in FIG. 6f to the position shown in FIG. 6a. However, the linkages interconnecting the baffle plates 12 and 14 are such that this ideal condition cannot be obtained. Instead, there is a slight decrease in the volume of the region 18 as the baffle plates 12 and 14 move from the position shown in FIG. 6e to that shown in FIG. 6f. During this interval the cold working fluid from the region 20 passes through the regenerator, picking up heat therefrom, before it is returned to the region 16. FIG. 6f illustrates the positions of the baffle plates 12 and 14 as the engine is approaching point D in the cycle. The pressure acting against the baffle plates is rotating gears 40 and 46 clockwise and counterclockwise, respectively. Linkage 64,68 is moving baffle plate 12 clockwise at a rapid rate relative to baffle plate 14 while baffle plate 14 is being moved clockwise by linkage 56,60. The baffle plate 14 reaches its clockwise limit of travel but the linkage 64,68 has not fully collapsed. Thus, between the positions shown in FIGS. 6f and 6a the angle between baffle plates 12 and 14 decreases thus permitting expansion of the working fluid in the regions 16 and 20. This completes one cycle of the engine.

As is evident from the foregoing description, gear 46 always rotates in the same direction as does the gear 40. Thus, the electrical generator 54 may be driven by either of these gears, either directly or indirectly. The generator may be mounted on one of the baffle plates within the region 18. With this arrangement electrical power is taken from the generator by an electrical connection to the generator, and no seal is required because no shaft for mechanical output power is required. If preferred, mechanical output power may be taken from the engine by means of a shaft driven by one of the baffle plates. For example, the baffle plate 12 may be pinned to its hinge pin and this pin extended through an end wall of the engine. The pin will oscillate thus providing output power.

The linkages 56, 60, 64 and 68 determine not only the relative timing of the movements of the baffle plates 12 and 14 but also the maximum and minimum volume contained within regions 16 and 20. Thus, these linkages may be changed depending upon the characteristics of the working fluid. In some instances it may be necessary, because of the lengths of one or more of the linkages, to provide a depression or well 70 in one of the baffle plates as illustrated in FIG. 6*a*. In this case the cold wall of the engine should be provided with a further mating well.

As previously indicated, the working fluid may be air or another working fluid depending upon the size, operating pressure, etc. of a particular engine. The refrigerant R-113 (Freon) is preferred for lower power engines where the volume 18 is maintained near atmospheric pressure. Since condensation of the refrigerant will occur on the cold wall of the engine, a reservoir 92 (FIG. 3) is connected by a drain tube 74 to the region 20 for receiving and collecting the condensate. A pump 76 is provided for pumping the condensate upward through a filter 78 and a return pipe 80 to a spray bar 82 (FIG.1) which extends longitudinally across the width of the regenerator return path 24. The spary bar 82 is positioned immediately before the regenerator 26 so that the condensate is sprayed into the vapor as it is being displaced from the region 20 to the region 16. The condensate then vaporizes upon being heated by the heat given out by the regenerator. Preferably, the spray bar is located to the left of the center line of the engine as viewed in FIG. 1 so that any condensate not vaporized in the regenerator will fall into the region of piping 32 where it will be vaporized by the higher temperatures present in this region.

Ideally, the condensate should be sprayed from spray bar 82 only when the working fluid is being transferred from region 20 to region 16. Thus, the pump 76 may be a piston pump located within the region 18 and driven from one of the gears 40 or 46 so that it injects condensate during the desired interval of each cycle. A throttle valve 84 may be provided to limit the volume of condensate returned to the spray bar 82, and thus may serve as a speed control means. A return pipe 86 returns to reservoir 72 any condensate pumped by pump 76 which cannot pass through the throttle valve 84.

FIG. 7 illustrates in schematic form several modifications which may be made in the embodiment shown in FIG. 1. The elements of FIG. 7 have been assigned the same reference numerals as FIG. 1 but with a prime. Baffle plates 12' and 14' are mounted for pivoting movement on separate parallel pivot axes 37' so as to follow separate arcuate paths of movement. The interior housing 10' is shaped in part as two intersecting arcuate surfaces so as to match closely the movements of the upper edges of baffle plates 12' and 14'.

As illustrated in FIG. 7, the mechanical timing mechanism of FIG. 1 may be replaced by a fluid actuated timing mechanism comprising a power piston 21 operating in a cylinder 23, and a displacement piston 25 operating in a cylinder 27. Piston 25 is pivotally connected to a fixed support 29 by a piston rod 59 and the cylinder 27 is pivotally connected to baffle plate 12'. Piston 21 is pivotally connected to baffle plate 14' by a piston rod 57 and cylinder 23 is pivotally connected to the baffle plate 12'. Cylinder 23 is connected by hoses or other conduits 31 and 33 to a fluid programmer 61 which is powered by a fluid power source 41. As subsequently described, programmer 61 selectively connects the hose 31 to a hose 43 which in turn is connected to a pressure accumulator 45. A connection 47 is provided to connect the output of accumulator 45 to a fluid motor 49 through a pressure regulator 63. The fluid motor drives a shaft 51 which provides the useful output power. The motor fluid after passing through motor 49 is returned to source 41.

The opposite ends of cylinder 27 are connected by hoses 53 and 55 to the programmer 61. The programmer, at appropriate times, selectively connects one of the hoses 53 and 55 to the high pressure side of fluid power source 41 and connects the other hose to the low pressure side.

The embodiment of FIG. 7 operates in a manner very closely approximating the ideal Stirling cycle illustrated in FIG. 5. Assume that the working fluid is at maximum volume at the higher pressure, i.e. at point A of the cycle shown in FIG. 5. The piston 21 is displaced to its left-most limit of travel within cylinder 23 so that the baffle plates 12' and 14' define between them a region 18' at its minimum volume thus making the total volume of regions 16' and 20' at its maximum value. Piston 25 is at its left-most limit of travel within cylinder 27 so that baffle plate 12' is at its clockwise limit of travel. At this point in the cycle the baffle plates 12' and 14' are vertical as shown in FIG. 7.

During the move from point A to point B in a cycle, programmer 61 connects hose 53 to the high pressure side of power source 41 and connects hose 53 to the low pressure side. This moves cylinder 27 to the left thus pivoting baffle plate 12' to its counterclockwise limit of travel. The programmer 61 connects hoses 31 and 33 to the high and lower pressure sides, respectively, of the fluid power source so that piston 21 tends to remain at its left-most position within cylinder 23. Thus, as baffle plate 12' pivots counterclockwise the piston rod 57 draws baffle plate 14' in the counterclockwise direction. As the baffle plates move in a counterclockwise direction the working medium is forced from the hot region 16' through the regenerator 26' to the cold region 20', the exit from region 16' being made through openings 28' and the entrance to region 20' being made through openings 30'.

At point B, the programmer 61 connects hoses 31 and 33 to the low and high pressure sides respectively of the fluid power source. This drives the piston 21 toward its right-most position within cylinder 23 and the piston rod 57 drives the baffle plate 14' clockwise to approximately the position shown in FIG. 7. During this interval high pressure is applied to cylinder 27 through hose 53 so the baffle plate 12' remains at its counterclockwise limit of travel closely against the hot wall 10*a'* of the engine.

At point C of the cycle, programmer 61 continues to apply high pressure from the power source 41 to the hose 33 to keep the piston rod 57 extended and maintain the separation between the baffle plates 12' and 14'. However, at point C the programmer connects hoses 53 and 55 to the low and high pressure sides, respectively, of the power source thus moving the cylinder 27 to the right so that piston 25 will again be at its left-most position within the cylinder. As cylinder 27 moves to the right it pivots baffle plate 12' clockwise to approximately the position shown in FIG. 7. As baffle plate 12' moves clockwise it acts through cylinder 23 and piston rod 57 to move the baffle plate 14' from its vertical position as shown in FIG. 7 to its clockwise limit of travel closely adjacent the cold wall 10*b'* of the engine.

As the baffle plates 12' and 14' are displaced clockwise, the cold working medium in region 20' is forced back through the regenerator 26' to the region 16'. The working medium is heated in region 16' thus expanding it and increasing the pressure of the working medium in regions 16' and 20' as well as the regenerator 26' and the regenerator return path 24'. This pressure acts against the left side of baffle plate 12' and the right side of baffle plate 14' tending to pivot the baffle plates toward each other. However, the separation of the baffle plates is maintained by the high pressure applied to cylinder 23 from programmer 61 and power source 41 until, at point D in the cycle, the programmer disconnects hose 33 from the high pressure side of fluid power source 41 and connects it instead to the hose 43 leading the accumulator. Between points D and A of the cycle the pressure in region 20' forces baffle plate 14' counterclockwise toward the vertical position. This moves piston 21 to the left thus forcing fluid under pressure out of cylinder 23, through hose 33, programmer 61, and hose 43 to the accumulator 45. Thus, it is during phase D-A that useful energy is obtained from the heat engine and stored in accumulator 45 for subsequent use.

At point A of the cycle the pressure in region 20' has forced baffle plate 14' to the vertical position so that piston 21 is in its left-most position in cylinder 23. Baffle plate 12' is still being held in the vertical position to which it was moved beginning at point C and extending through phase C-D of the cycle. Thus, the engine has completed one complete cycle.

While energy must be expended in operating pistons 21 and 25, the energy so used is less than the useful output obtained from cylinder 23 during phase D-A. Relatively little energy is required to operate piston 25 because its movement merely pivots the baffle plates 12' and 14' in synchronism. Since regenerator 26' and return path 24' ideally offer little or no resistance to fluid flow, there is no large difference in pressures in regions 16' and 20' tending to resist movement of the baffles. Although piston 21 moves baffle plate 14' relative to baffle plate 12' in a direction tending to reduce the total volume in regions 16' and 20', it does so during that phase of the cycle when the working medium is at its lower temperature $T_L$ and the pressure in these regions is relatively low. On the other hand, when piston 21 is driven by the pressure acting on baffle plate 14', to obtain the output power, the working medium is at its higher temperature $T_H$ and higher pressure.

FIG. 7 does not show a specific means for heating the hot side region 16' or cooling the cold side region 20'. The heating means and cooling means may include piping through which the heating and cooling fluids are circulated, as shown in FIG. 1. Alternatively, the hot side wall 22a' may be positioned against a heat source for the direct transfer of heat through the wall 22a'. Thus, the wall 22a' may abut a flue through which waste heat is passing or it may abut a hot wall of a fireplace. In one arrangement, the wall 22a' may be disposed inside a loft or attic which attains a relatively high temperature and the heat engine may be mounted so that it extends through the wall of the loft so as to expose the cold wall 22b' to the relatively cooler air outside the loft. In one particularly desirable arrangement the heat engine is supported on a pontoon or raft with the cold side 22b' extending into the water of a cool flowing stream with the hot surface 22a' being heated from a solar collector. Any of these methods of heating and cooling may also be employed with the embodiment of FIG. 1.

The embodiments of FIGS. 1 and 7 both have the baffle plates pivoted at their lower edges. This is desirable where the working medium condenses. In this regard, FIG. 7, like FIG. 1 may be provided with a condensate return means. If the working medium is not a condensing medium, then it is preferable to invert the heat engine so that the baffle plates are hinged at their upper edges.

The baffle plates have thus far been described as relatively thin flat rectangular plates. However, as used herein the term baffle plate is intended to include other shapes such as those shown in FIGS. 8a–8b, 9a–9b and 10. In FIGS. 8a and 8b, a baffle plate 100 is provided with a curved working surface 100a having a stiffening member 100b at each end. This arrangement provides a relatively stronger baffle plate and is admirably suited for use in a heat engine which is to be mounted in a spherical container. It will be understood that when a baffle plate like the baffle plate 100 is utilized in a heat engine such as that shown in FIG. 1, the hot and cold walls 10a and 10b are provided with a curvature matching the curvature of the working surface 100a. Thus, the baffle plate 100 is admirably suited for use in an engine which is to be mounted in a spherical high pressure housing.

FIGS. 9a and 9b illustrate a modification of the baffle plate shown in FIGS. 8a and 8b. The baffle plate 101 is like the baffle plate 100 except that it is provided with a cover plate 101a thus forming an enclosed volume within the baffle plate. If this volume is made fluid-tight, and openings are provided from the interior of the baffle plate to a pipe or fluid conductor 102, then the baffle plate 101 may itself serve as a heat transfer surface. For example, in FIG. 9b the fluid conductor 102 is provided with a plurality of openings 103, a partition 104 for blocking fluid flow, and a plurality of outlet openings 105. Assuming that baffle plate 101 is to be utilized on the hot side of the engine shown in FIG. 1, the lower end of pipe 102 is connected to the output of the heat exchanger so that hot fluid flows through 102 and openings 103 into the baffle plate. This heat is then transferred to the working medium in region 16. The heating fluid flows out through outlets 105 and through the return piping 106 to the cool side of the heat exchanger. The piping 102 and 106 serves a dual purpose and is rotatably supported in the engine housing so that it also functions as the hinge or pivot for the baffle plate.

FIG. 10 illustrates a further modification of a baffle plate which provides for better sealing between the end of the baffle plate and the inner surface of the housing 10. In FIG. 10 the baffle plate 12'' is shaped like a sector of a cylinder thus providing a larger sealing surface 12a''. The baffle plate 12'' may be either solid or constructed of sheet or plate-like materials.

FIG. 11 illustrates another embodiment of the invention which in essence comprises two heat engines like that shown in FIG. 1. However, by arranging the heat engines as shown in FIG. 11 a common baffle plate may be employed in two engines. Thus, in FIG. 11 the baffle plate 112a in the upper engine and baffle plate 112b in the lower engine are a single plate mounted on a hub 113 for pivoting about an axis 115. In like manner, plates 114a and 114b are a common plate having a hub (not shown) which also pivots about pivot axis 115. The advantage of this arrangement is that a single timing mechanism, illustrated diagramatically at 117, may be located in either engine and drive the baffle plates for both engines. It will of course be recognized that, depending upon the pressures involved, it may under certain circumstances be necessary to provide timing mechanisms in both chambers because of the forces exerted on the baffle plates. The timing mechanism 117 may be either the type shown in FIG. 1 or the type shown in FIG. 7 and, depending upon which mechanism is employed, the heat engines of FIG. 11 will operate as described with reference to FIG. 1 or FIG. 7. The useful output may be either electrical, mechanical or fluid, as discussed above with reference to the embodiments of FIGS. 1 and 7.

From the foregoing description it is seen that the present invention provides a simple inexpensive heat engine particularly adapted to convert waste heat energy to electrical energy. The device does not require mechanical input energy and, in some embodiments, requires no energy input other than heat. The arrangement is such that seals in the walls of the working chamber are not required in some embodiments, and in others the need for a sliding piston is avoided thus obviating the need for a sliding piston seal.

Since the Stirling cycle is a completely closed reversible cycle it will be understood that the present invention may be reversibly operated to function as a refrigerator or heat pump, depending upon the heat applied to, or taken from the hot and cold sides of the engine. With respect to FIG. 1, the engine may be reversed simply by applying electrical power to a motor which replaces the generator 54 and drives baffle plates 12 and 14 through gears 40 and 46.

While several preferred embodiments of the invention have been shown and described in specific detail, it will be understood that various modifications, combinations, and substitutions may be made in the illustrated embodiments without departing from the spirit and scope of the invention as defined by the appended claims. It is intended therefore to be limited only by the scope of the appended claims.

I claim:

1. In a Stirling cycle device having means defining a working chamber of constant volume, the improvement comprising first and second means disposed within said chamber and defining with said chamber first, second and third regions each of variable volume said first and second means and said means defining said working chamber sealing said first and second regions to prevent the ingress or egress of fluid thereto or therefrom.

2. The improvement as claimed in claim 1 and further including means for moving said second means relative to said first means to thereby increase or decrease the volume of said third region while simultaneously decreasing or increasing, respectively, the total volume in said first and second regions.

3. The improvement as claimed in claim 1 or claim 2 and further including means for moving said first means and said second means at substantially the same rate in a first or a second direction to thereby increase the volume in said second region while decreasing the volume in said first region, or increase the volume in said first region while decreasing the volume in said second region, the volume of said third region remaining substantially constant.

4. The improvement as claimed in claim 3 wherein a working fluid is disposed in said first and second regions and a flow path is provided for flow of said working fluid between said first and second regions.

5. The improvement as claimed in claim 4 and further comprising means for applying heat to said first region and removing heat from said second region; and regenerator means disposed in said flow path for removing heat from or giving up heat to said working fluid as it flows between said first and second regions.

6. In a Stirling cycle device having housing means defining a working space of constant volume and a displacement means cooperating with said housing means for dividing said working space into first and second regions which are, together, sealed to prevent the ingress of fluid, the improvement wherein said displacement means comprises first and second means within said working space for defining a variable volume isolated from said first and second regions; and means for varying the volume in said variable volume displacement means.

7. The improvement as claimed in claim 6 and further comprising means for moving said variable volume displacement means within said working space to vary the volumes of said first and second regions relative to each other.

8. The improvement as claimed in claim 7 and further comprising:

a regenerator means disposed in a regenerator path connecting said first and second regions for removing heat from, or adding heat to, a working fluid moving between said first and second regions.

9. The improvement as claimed in claim 6 or claim 8 and further comprising means for applying heat to the working fluid in said first region and means for removing heat from the working fluid in said second region.

10. In a heat engine having means defining a chamber, displacement means disposed within said chamber and separating said chamber into first and second regions closed to the surrounding environment, a regenerator path connecting said first and second regions and forming a bypass around said displacement means for a working fluid, and means for applying heat to the working fluid in said first region and removing heat from the working fluid in said second region, the improvement wherein said displacement means comprises a variable volume displacement means for displacing a variable volume within said chamber between said first and second regions but separated therefrom, whereby the pressure in said first and second regions may be varied.

11. The improvement as claimed in claim 10 wherein said working fluid is air.

12. The improvement as claimed in claim 10 and further comprising condensate return means for collecting condensate from said second region and spraying it into said regenerator path, said working fluid being a condensing refrigerant.

13. The improvement as claimed in claim 12 wherein said condensate return means includes a pump and said variable volume displacement means comprises first and second baffle plates defining a third region intermediate said first and second regions, and drive means disposed within said third region for controlling the relative motions of said baffle plates and driving said pump.

14. The improvement as claimed in claim 10 wherein said variable volume displacement means comprises first and second baffle plates defining a third region disposed intermediate said first and second regions.

15. The improvement as claimed in claim 14 wherein said first and second baffle plates are hinged for arcuate movement in said chamber.

16. The improvement as claimed in claim 15 wherein said first and second baffle plates are hinged for arcuate movement about a common axis.

17. The improvement as claimed in claim 15 wherein said first and second baffle plates are hinged for arcuate movement about different parallel axes.

18. The improvement as claimed in claim 14 wherein said first and second baffle plates have curved surfaces facing said first and second regions, respectively.

19. The improvement as claimed in claim 14 wherein each of said baffle plates comprises means defining an enclosed volume.

20. The improvement as claimed in claim 19 and further comprising pivot means for pivotally supporting said first and second baffle plates, said pivot means for at least one of said baffle plates comprising a fluid conduit having openings therein connecting with the enclosed volume of said one baffle plate.

21. The improvement as claimed in claim 14 and further comprising means for supporting said baffle plates for arcuate movement in said chamber.

22. The improvement as claimed in claim 21 wherein said variable volume displacement means further comprises a first and second gear means mounted on said second baffle plate; first linkage means connected between said first gear means and said first baffle; second linkage means connected to said second gear means and a fixed pivot within said chamber; and an output gear means supported by said second baffle and adapted to turn in response to movement of either said first or said second gear means.

23. The improvement as claimed in claim 22 and further comprising means for deriving output power from said output gear means.

24. The improvement as claimed in claim 23 wherein said means for deriving output power includes an electrical generator mounted within said third region.

25. The improvement as claimed inn claim 10, claim 14 or claim 23 wherein said working fluid is a condensing refrigerant.

26. The improvement as claimed in claim 21 wherein said variable volume displacement means further comprises: first fluid actuated piston means disposed in said third region and connected between one of said baffle plates and a fixed pivot; second fluid actuated piston means connected between said first and second baffle plates; and programmer means for selectively actuating said first and second piston means to cyclically move said baffle plates at the rate in a given direction, move the second of said baffle plates relative to the first baffle plate, move said baffle plates at the same rate in a direction opposite said given direction, and permit movement of said second baffle plate relative to said first baffle plate in response to the pressure of said working medium in said second region.

27. A device comprising two heat engines as claimed in claim 21 wherein the two chambers are arranged as diametrically opposite sectors of a cylinder and wherein the first baffle and second baffle plates of one engine extend into and form the baffle plates of the second engine.

28. The improvement as claimed in claim 21 and wherein said variable volume displacement means further comprises drive means disposed within said third region and responsive to movement of one of said baffle plates for moving the other of said baffle plates.

29. The improvement as claimed in claim 28 and further comprising output means responsive to said drive means for producing output power.

30. The improvement as claimed in claim 29 wherein said working fluid is air, said improvement further comprising; means for applying heat to said first region; means for removing heat from said second region; and regenerator means disposed in said regenerator path for adding or removing heat from said working fluid as it moves from said second to said first region, and from said first to said second region, respectively.

31. The improvement as claimed in claim 29 wherein said output means includes a cylinder and piston connected between said baffle plates.

32. The improvement as claimed in claim 29 wherein said output means comprises an electrical generator.

33. The improvement as claimed in claim 32 wherein said electrical generator is disposed between said baffle plates within said chamber.

* * * * *